US006154941A

United States Patent [19]

Cadena et al.

[11] Patent Number: 6,154,941

[45] Date of Patent: Dec. 5, 2000

[54] CRANKSHAFT THRUST FACE BURNISHER AND METHOD

[75] Inventors: Luis M. Cadena, Rochester Hills, Mich.; Hans T. Steffens, Erkelenz, Germany

[73] Assignee: Hegenschiedt-MFD Corporation, Sterling Heights, Mich.

[21] Appl. No.: 09/127,091

[22] Filed: Jul. 31, 1998

[51] Int. Cl.[7] ..... B21C 37/30

[52] U.S. Cl. ..... 29/90.01; 29/90.08

[58] Field of Search ..... 29/6.01, 90.08, 29/888.08, 90.01; 72/110

[56] References Cited

U.S. PATENT DOCUMENTS

| | | | |
|---|---|---|---|
| Re. 31,593 | 6/1984 | Judge | 51/58 |
| 995,749 | 6/1911 | Williams | 29/90.01 |
| 1,523,571 | 1/1925 | Wolfe | 29/90.01 |
| 2,835,958 | 5/1958 | Mock | 29/90.01 |
| 3,791,000 | 2/1974 | Kunze | 29/90.01 |
| 3,930,294 | 1/1976 | Kalen | 29/90.01 |
| 4,536,931 | 8/1985 | Roper . | |
| 4,554,811 | 11/1985 | Hayashi | 29/6.01 |
| 5,664,991 | 9/1997 | Barton, II . | |

FOREIGN PATENT DOCUMENTS

| | | |
|---|---|---|
| 778958B | 11/1980 | U.S.S.R. . |
| 1581569 | 7/1990 | U.S.S.R. . |

*Primary Examiner*—Irene Cuda
*Assistant Examiner*—Anthony L. Green
*Attorney, Agent, or Firm*—Howard & Howard

[57] ABSTRACT

A burnisher for use with a lathe or production machine to burnish opposing thrust faces of a crankshaft laterally fixed and rotatably driven thereby. The tool of the burnisher has a plurality of opposing burnishing rollers that operatively engage under opposing torsional load thrust faces of the crankshaft rotatably driven by the lathe or production machine. The burnisher features biasing spring construction that provides for the movement of the burnishing tool laterally into a centered working position relative to the opposing surfaces of the crankshaft when sufficient turning force or torque is applied to the burnishing tool. This construction provides for even application of burnishing force by the burnishing rollers onto the thrust faces for application in which the workpiece is fixed laterally without becoming distorted.

11 Claims, 5 Drawing Sheets

CRANKSHAFT THRUST FACE BURNISHER AND METHOD

TECHNICAL FIELD

The present invention relates to burnishing tools for surface finishing plastically deformable metal parts. More specifically, the invention relates to a new and improved burnishing tool adapted to plastically work and finish the thrust walls of an internal combustion engine crankshaft so that they are free from distortion and have improved surface finish quality and service life.

BACKGROUND ART

In an engine, parallel and spaced apart thrust faces of a crankshaft act to axially locate the crankshaft within an engine block. During vehicle operation, in which many transmission upshifts and downshifts are made and in which the engine crankshaft can rotate at relatively high speeds, the thrust faces thereof come into contact with the thrust face bearings of the engine block. The frictional contact requires the thrust faces to have very smooth surfaces free from distortion, or runout, for smooth operation and for optimizing wear characteristics between these parts.

Prior to the present invention, burnishing or roller finishing equipment and procedures have been employed to provide highly finished wear surfaces. Generally such burnishing is drawn to a surface finishing operation for plastically deformable metal parts in which the metal is cold worked but is not removed. Such plastic deformation is completed when the roughness profile of the surface is eliminated or reduced and a desired smoothness has been achieved. Various machining operations often proceed the burnishing operation at the same station.

Before this invention, the crankshaft thrust faces have been roller burnished during the manufacturing process to materially improve the mechanical properties of the thrust face surfaces. Commonly used crankshaft roller burnishing equipment and methods include the mounting of a crankshaft to be worked between a pair of special workpiece holders. The workpiece holders arc configured in such a way as to permit lateral movement of the crankshaft (axially) to a limited extent during rotation. The crankshaft is rotated at a predetermined speed and the roller burnishing tool is advanced from a retracted position to a position between the crankshaft thrust faces. The burnishing tool is turned in a limited arc in a first direction until burnishing rollers thereof physically engage opposing thrust faces at a predetermined torque. The burnishing tool is held in this load position for a period of time to mechanically work and plastically smooth the thrust face surfaces. The burnishing tool is then turned out of engagement with the crankshaft thrust faces and returned to its retracted position.

With prior burnishing processes, the burnishing tool often does not engage each of the opposing thrust faces simultaneously as desired for even distribution of the burnishing loads but rather engages one thrust face before it engages the other. When this occurs, the force imparted by the burnishing tool is concentrated on the first thrust face that the tool contacts. The first thrust face tends to bend and distort under the increased applied burnishing load, which would be up to double the force or load than if both thrust faces were contacted simultaneously to evenly distribute the load. Such distortion of the thrust faces results in crankshaft rejection causing scrapping of such crankshafts for recycling.

Distortion of the crankshaft thrust faces crankshaft has been avoided by allowing the crankshaft to float axially relatively to the burnishing tool during the burnishing operation. This has been accomplished by employing centering springs on the crankshaft holding and turning unit so that the crank shaft can move axially relative to the burnishing tool when the tool is operatively positioned between and engages with the thrust faces whereby the tool forces such centering. With such a spring biased workpiece positioning arrangement, the relative movement between the tool and thrust faces results in the centering of the tool between the thrust faces and the simultaneous burnishing of the opposing thrust faces.

However, manufacturing situations arise in which it is not desirable or not possible to allow such lateral or axial movement of the crankshaft. One example of such a situation is one in which the crankshaft cannot be run on a production machine. This can occur when small test runs are conducted on a lathe. This can also occur when the crankshaft thrust faces become damaged during the manufacturing process and, as a result, must be either scrapped or further machined to a dimension above production tolerance. Instead of setting up the production burnishing machine to this larger dimension to rework such damaged crankshafts, which is time consuming, it is generally preferable and more efficient to burnish these crankshafts off line on a lathe.

However, burnishing crankshafts in a lathe or other machine in which the crankshaft cannot float has presented the problem of distorting the thrust faces in situations where the burnishing tool contacts one thrust face before the other. Additionally, it is desirous in some circumstances to have a production configuration in which the crankshaft does not float laterally during burnishing. Since allowing the crankshaft to float axially or laterally relative to the burnishing tool is the only known practical means to prevent distortion of the thrust faces, distortion has remained a problem with such laterally fixed burnishing apparati and methods. Hence, there is a continuing need to provide a method and apparatus in which the burnishing tool is able to move laterally relative to the crankshaft thrust faces to prevent distortion of the thrust faces and provide a finely finished part.

SUMMARY OF THE DISCLOSURE AND ADVANTAGES

According to the present invention there is provided a crankshaft thrust face burnishing assembly or burnisher adapted to be used in conjunction with a lathe or production machine for burnishing opposing surfaces of a workpiece. The burnishing assembly comprises a burnishing tool having a plurality of burnishing rollers. The burnishing tool is adapted such that the burnishing rollers will engage the opposing surfaces when the burnishing tool is rotated. The burnishing assembly further includes at least one biasing member operatively connected to the burnishing tool. The biasing members urge the burnishing tool into a centered position that laterally positions the burnishing tool between the opposing surfaces. The biasing members additionally permit the burnishing tool to move laterally relative to the opposing surfaces when sufficient force is applied to the burnishing tool by the thrust faces, which are resistant to lateral movement because the crankshaft is laterally fixed.

Accordingly, there is provided a burnishing tool assembly which, when the burnishing tool is rotated into engagement with the opposing surfaces the burnishing tool, is permitted to move laterally relative to the opposing surfaces when the opposing surfaces are not contacted simultaneously by the burnishing rollers. This lateral movement permits even application of force by the rollers onto the thrust faces for applications in which the workpiece is fixed laterally.

One of the features, objects and advantages of this invention is to provide a new and improved burnisher apparatus which incorporate spring units which allow the burnishing tool carried by the apparatus to operatively center between opposing thrust faces of a crankshaft so that both thrust faces are burnished simultaneously and free from distortion.

BRIEF DESCRIPTION OF THE DRAWINGS

Other features, objects and advantages of the present invention will be readily appreciated, as the same becomes better understood by reference to the following detailed description when considered with the accompanying drawings wherein.

PREFERRED EMBODIMENT OF THE INVENTION

Figure 1:
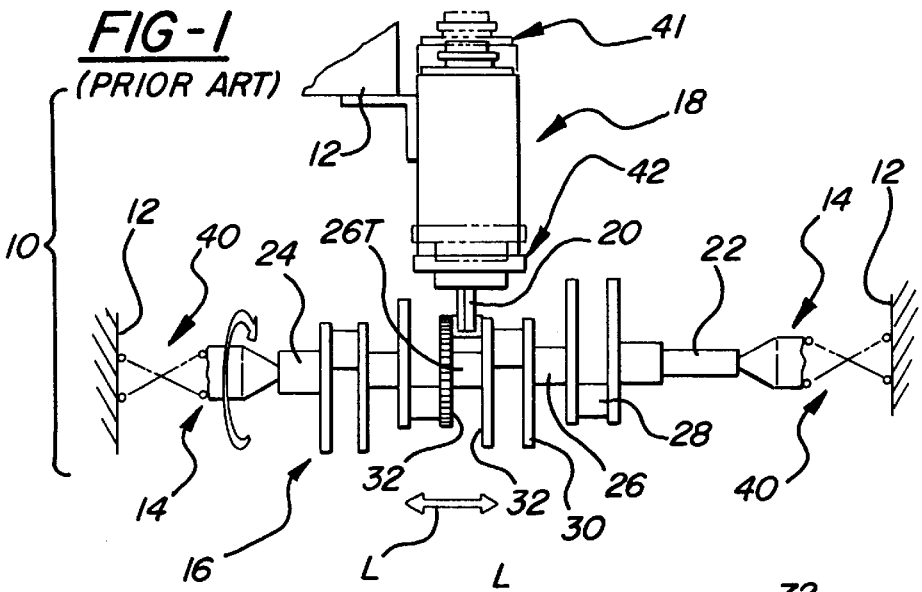
FIG-1 (PRIOR ART)
FIG. 1 is an elevational view of an internal combustion engine crankshaft in a crankshaft thrust face burnishing apparatus according to the prior art.

A portion of the prior art production crankshaft burnishing machine is shown generally at 10 in FIG. 1. The burnishing machine includes a frame 12, workpiece holders 14 for holding a crankshaft 16, and a burnishing assembly 18. In addition, the burnishing machine 10 may also include a cutting tool assembly (not shown) for machining surfaces of a crankshaft or other machining or metal working operations. However, the present invention relates to a machine and operation in which surfaces of the workpiece are burnished or mechanically worked to reduce roughness and provide a highly finished surface as will be discussed.

Turning now to the workpiece, the crankshaft includes a nose 22, an opposing end 24, a plurality of main 26 and pin journals 28, and counterweights 30 disposed between the main 26 and pin journals 28. In an engine assembly (not shown), the main journals 26 of the crankshaft 16 are retained in corresponding main bearings (not shown) in an engine block. One crankshaft main journal 26T has a pair of opposing thrust faces 32, each thrust face 32 located on either side of a main journal 26T. The thrust faces 32 of the crankshaft 16 contact either side of the corresponding main bearing (not shown) in the engine block (not shown), or thrust bearing, as the crankshaft 16 moves forward and rearward as it rotates in the engine block (not shown) during engine operation and particularly during gear shifts. Since the thrust faces 32 are wear surfaces, it is important that they have a uniform and finely finished surface that is also free from distortion. Accordingly, the thrust faces 32 of a crankshaft 16 arc burnished to mechanically work the surfaces and provide an improved finish for improving crankshaft performance and service life.

Returning to FIG. 1, the crankshaft 16 is disposed between and held in the workpiece holders 14 at the nose 22 and opposing end 24 of the crankshaft. The workpiece holders 14 are operatively attached to the frame 12. One workpiece holder is connected to a drive mechanism (not shown) that rotates the crankshaft 16 during the burnishing operation. The workpiece holders 14 are capable of floating laterally L in unison during the burnishing operation but are biased into a neutral or central position by mechanisms 40.

The burnishing assembly 18, which is operatively attached to the frame 12, includes a burnishing tool 20 having a pair of opposing rollers 50. Additionally, a pair of actuators (not shown) are operatively connected to the burnishing tool 20. When the burnishing tool 20 is in a retracted position 41 prior to burnishing, the burnishing tool 20 is spaced apart from the crankshaft 16 and perpendicularly oriented to the axis of the crankshaft and is proximate to the thrust faces 32. During burnishing, the burnishing tool 20 is oriented in an operating position 42 where the burnishing tool 20 is centrally located between the crankshaft thrust faces 32. The first actuator (not shown) is adapted to advance the burnishing tool 20 between the retracted 41 and operating positions 42. However, the burnishing tool 20 being fixed to frame 14 cannot move laterally with respect to the crankshaft 16.

Figure 3:
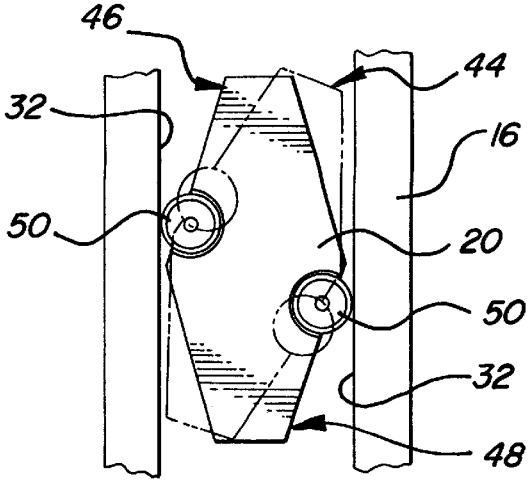
FIG. 3 is a front view of a portion of a burnishing tool engaging crankshaft thrust faces.

The burnishing tool 20 has a diamond-like cross-section, such as shown in FIG. 3, which when oriented in a first non-burnishing position 44 is narrow enough to operatively fit between the opposing thrust faces 32 of a journal 26T. As the burnishing tool 20 is subsequently rotated out of the first position 44 and into a second burnishing position 46; each burnishing roller 50 moves toward its corresponding thrust face 32. The second actuator (not shown) is adapted to turn the burnishing tool 20 in a rotational direction 48 and move the burnishing tool from the first 44 and second 46 positions.

In operation, with the crankshaft 16 loaded in the workpiece holders 14, the crankshaft 16 is rotated by the drive mechanism (not shown). The first actuator (not shown) advances the burnishing tool 20 from the retracted position 41 into the operating position 42 until the burnishing tool 20 is located between the crankshaft thrust faces 32. While the crankshaft 16 is still being driven about its axis, the second actuator (not shown) turns the burnishing tool 20 into engagement with the thrust faces 32 so that the hardened work rollers 50 of the burnishing tool 20 contact the thrust faces 32 under torsional load, as best seen in FIG. 3. More particularly, during crankshaft rotation, the rollers 50 move toward the thrust faces 32 until they contact the thrust faces 32 and a predetermined torque is obtained. The thrust faces 32 are mechanically worked until a desired smoothness is achieved. Alternatively, instead of engaging the thrust faces 32 after the crankshaft 16 is rotatably driven, the crankshaft 16 may be rotatably driven after the rollers 50 are engaged and held into contact with the thrust faces 32 at the predetermined torque.

Optimally, each roller 50 contacts the thrust face 32 proximate to it simultaneously. However, if one roller 50 contacts a thrust face 32 before the other roller 50 contacts its corresponding thrust face 32, the crankshaft 16 is forced to float laterally L until each roller 50 is contacting its corresponding thrust face 32. Thus, the burnishing tool 20 centers itself between the thrust faces 32.

Figure 2:
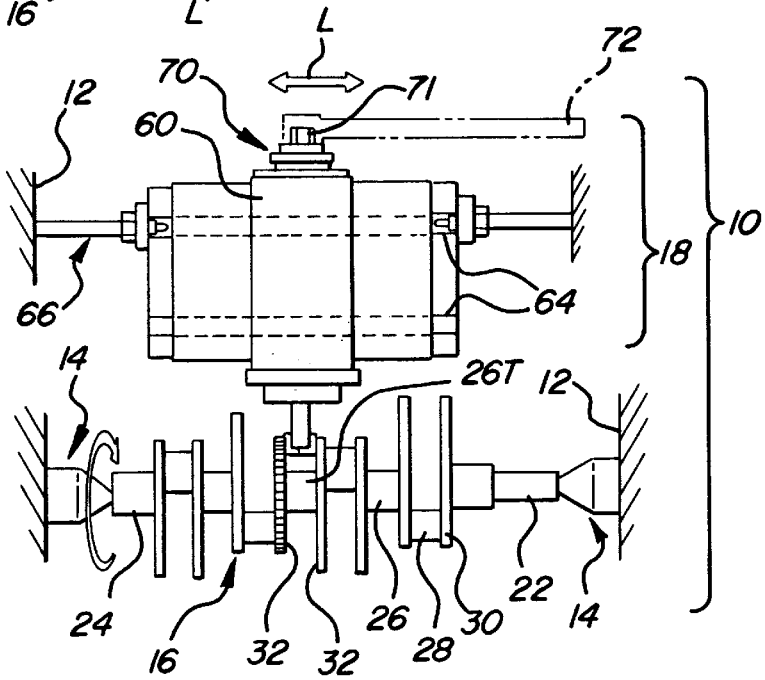
FIG. 2 is an elevational view similar to that of FIG. 1 but illustrating a crankshaft thrust face burnishing apparatus according to the present invention.

The present invention, generally shown in FIG. 2, is for use with burnishing configurations where the crankshaft 16 is not permitted to float laterally relative to the burnishing assembly. This laterally fixed crankshaft configuration can be found in some production crankshaft burnishing machines and in non-production machines such as lathes.

The present invention differs in construction and operation from the prior art in that it is the burnishing tool assembly 18, and not the crankshaft 16, that permitted to float laterally L as the burnishing rollers 50 engage the thrust faces 32. This difference provides the needed flexibility for manufacturing positions in which the crankshaft is laterally fixed. Again, as in the prior art, the crankshaft 16 is disposed between the workpiece holders 14. However, in one preferred embodiment, the work piece holders do not float and one of the workpiece holders is connected to a drive mechanism (not shown) which turns the crankshaft 16.

Referring now to FIGS. 4–7, the burnishing assembly 18 includes a housing 60, a guide assembly 64, and a pair of biasing members 66. The assembly 18 may also include a stationary platform 62 that is in turn attached to the frame 12, or in the case of a lathe, a tool post 100. For reasons of increasing the robustness of the burnishing assembly 18 design, the housing 60 may further comprise a base 89 and support members 90 attached to the base 89 and housing 60. The plungers 82 of the biasing members 66 can contact any component fixedly attached to the housing 60 to achieve the object of centering the housing 60. The housing 60 contains a shaft 68, the lower end of which extends from the housing 60 and is operatively attached to a burnishing tool 20. The end 70 of the upper shaft 68 is connected to a first actuator (not shown) that is adapted to rotate the shaft 68 and in turn rotate the burnishing tool 20 so that the burnishing rollers 50 of the tool operatively engage the opposing thrust faces 32 of the crankshaft. It is also contemplated that the upper end of the shaft 68 be provided with a polygonal configuration such as a hexagon 71. This polygonal end is adapted to be operatively engaged by a torque wrench 72 which can be manually turned to turn the tool 20 to effect the loaded engagement of the rollers 50 with the thrust faces.

Figure 4:
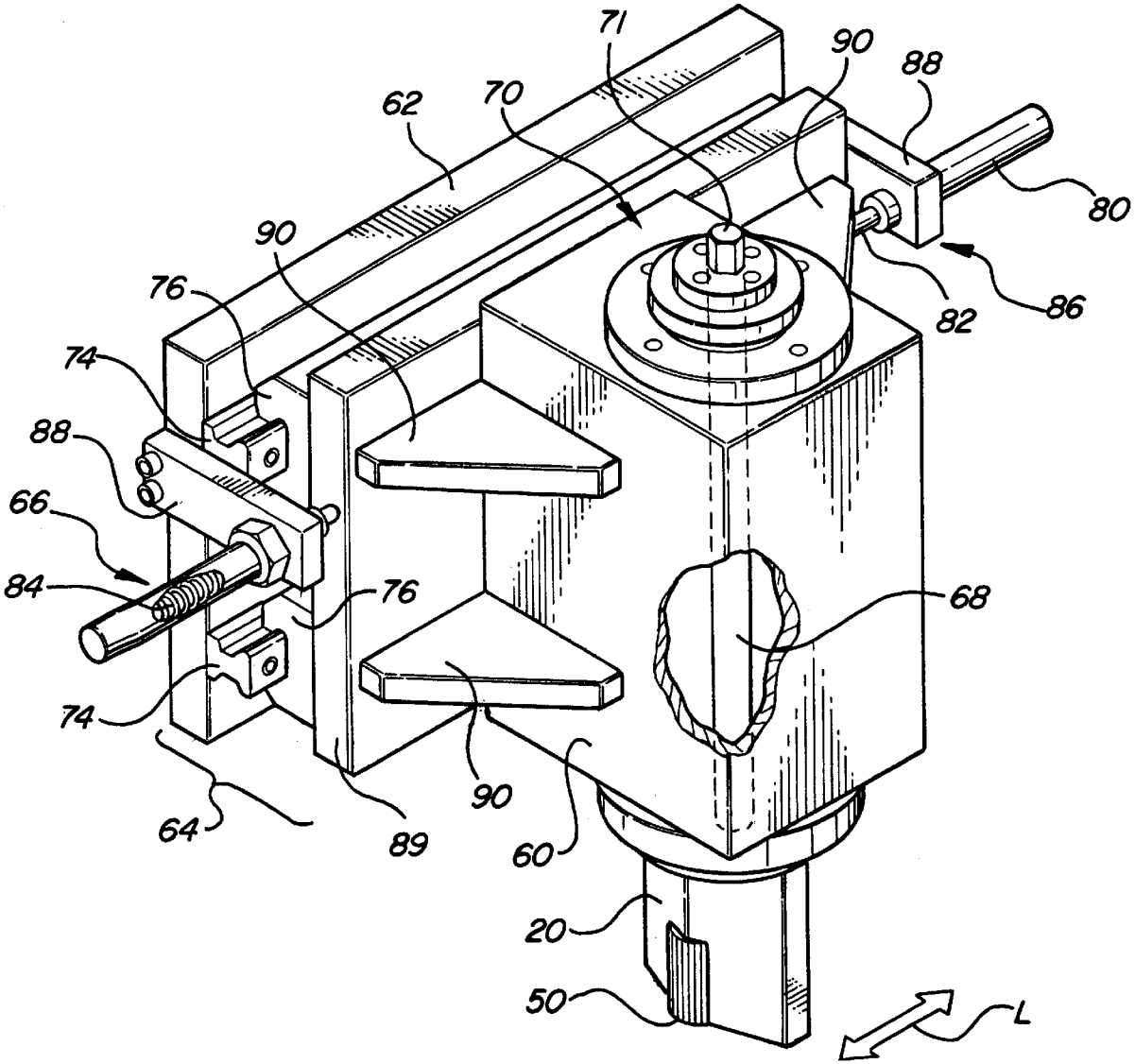
FIG. 4 is a pictorial view of one of the preferred embodiments of a crankshaft thrust burnisher according to the present invention.
Figure 5:
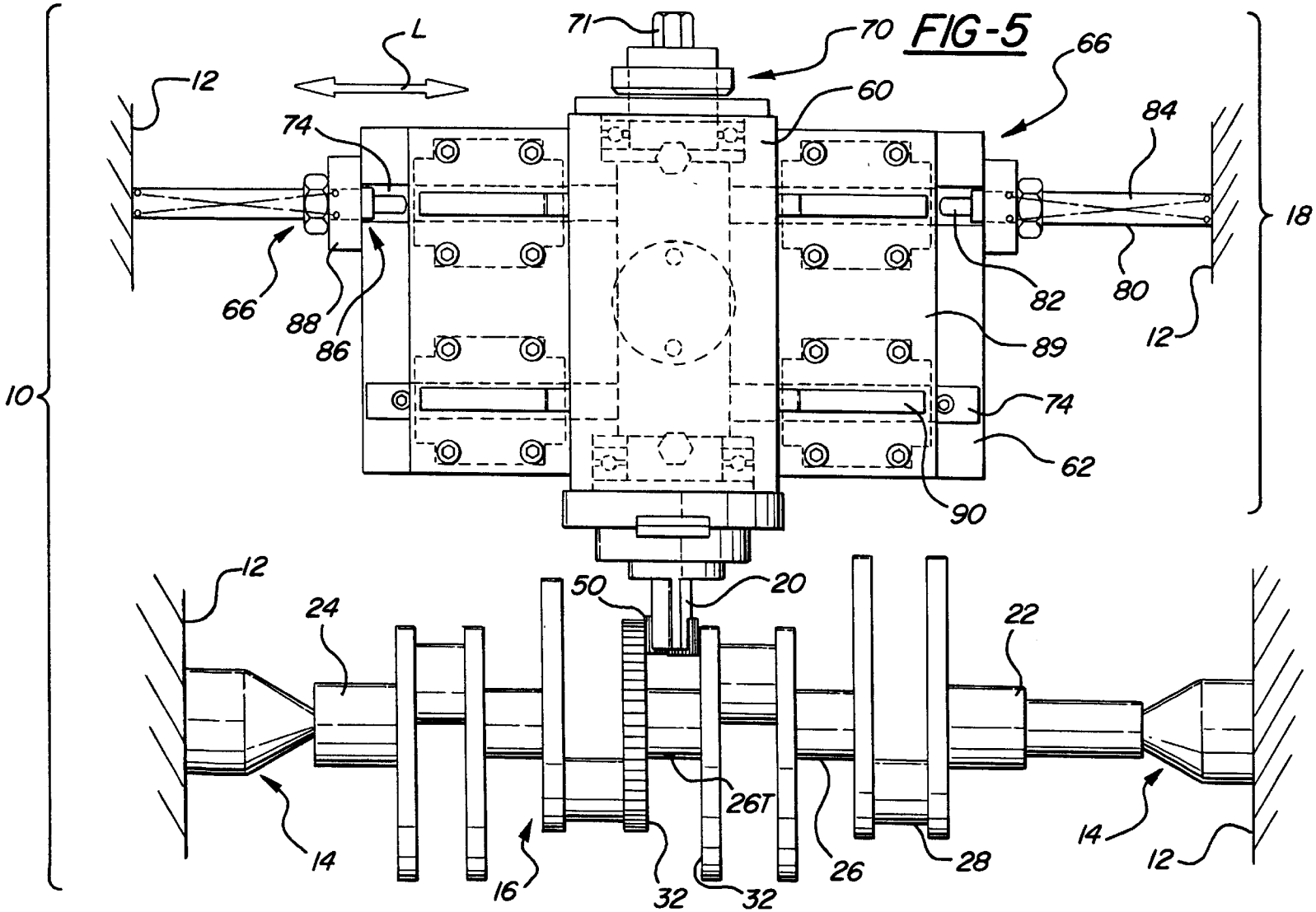
FIG. 5 is an enlarged and more detailed view of the construction of FIG. 2.
Figure 6:
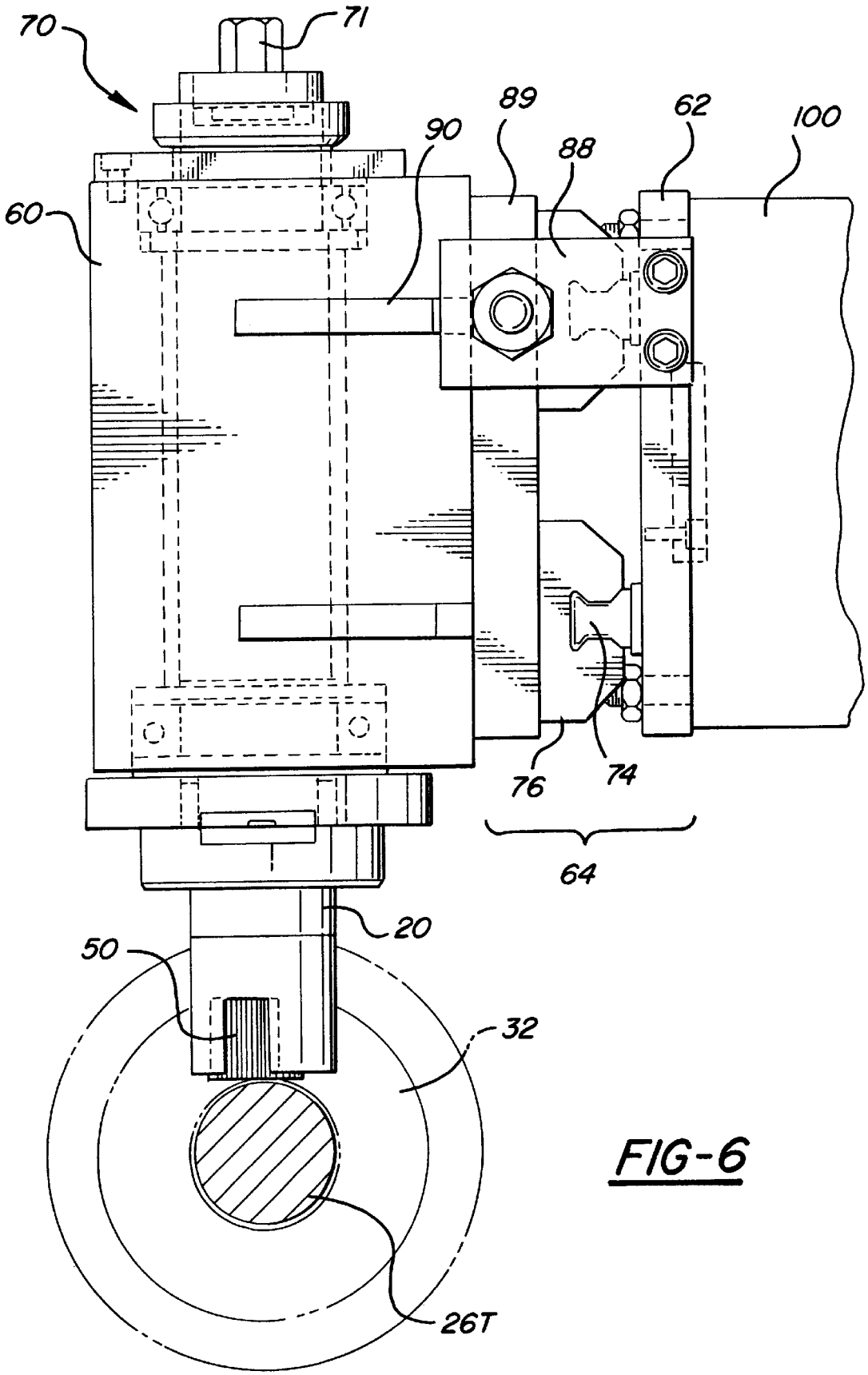
FIG. 6 is a side elevational view of the present invention.
Figure 7:
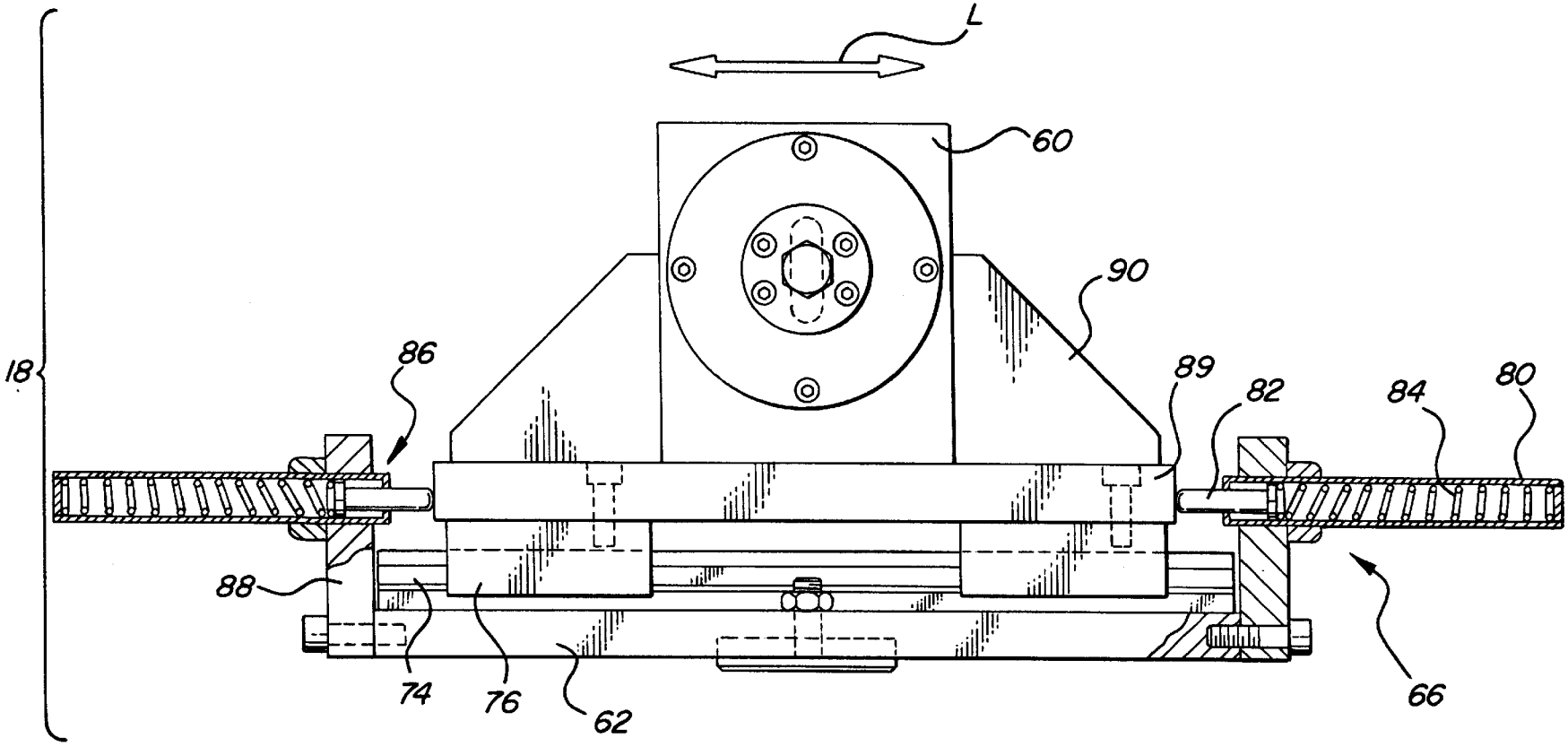
FIG. 7 is a partial cross-sectional view taken along sight line 7—7 in FIG. 5.

The guide assembly 64 includes a pair of laterally spaced and parallel guide rail members 74 fixed to the stationary platform 62 and a sliding carrier member 76 with parallel grooves 77 that slidingly fit on the guide rails. The carrier member 76 is secured to housing 60 by way of the housing base 89. Web-like triangular supports 90 are secured between the base 89 and the housing 60 for reinforcement as best shown in FIG. 4. With this construction the burnishing assembly housing 60, mounted to the carrier member is permitted to slide relative to the frame 12 via the guide assembly 64. However, any suitable mechanism that permits lateral movement L relative to the crankshaft 16 motion in either direction is acceptable.

Each biasing member 66 includes a cylinder 80, a plunger 82, and spring 84. The plunger 82 is retained at one end 86 of the cylinder 80 and is permitted to move axially within the cylinder 80. The spring 82 is contained within the cylinder 80 and abuts the plunger 82. Accordingly, the plunger 82 is normally biased in an extended position relative to the cylinder 80. Of course, a mechanism other than a springed plunger can be used, such as a hydraulic cylinder or shock absorber, or any spring-like biasing device. The biasing members 66 are arranged in opposing relationship to one another and are oriented such that the axis of the plungers are parallel with the guide assemblies 64. The cylinder 80 is operatively attached to the frame 12 via blocks 88 that are attached to platform 62. The plunger 82 contacts the burnishing assembly housing 60. Thus, the biasing members 66 act to urge the burnishing assembly housing 60 into a central or neutral position. Moreover, it is also not important that the cylinder 80 be attached directly to the frame 12. Rather the cylinder 80 only need be attached to a component that is in turn directly or indirectly attached to the frame 12.

In operation, the burnishing assembly 18 is advanced toward the crankshaft thrust faces 32 in the same manner as the prior art, discussed above. However, during the advancement 42 and retraction 41 of the burnishing assembly 18 by the first actuator (not shown), the burnishing assembly 18 is retained in a central or neutral position by the biasing members 66. This insures that the burnishing tool 20 will not collide with the thrust faces 32 and damage the crankshaft 16 during these perpendicular movements. As mentioned above, the present invention is well adapted for use on a lathe. To utilize the present invention on a lathe, the platform 62 is attached to a tool post 100 on the lathe (not shown) which is in turn attached to a cross slide (not shown). The burnishing tool assembly 18 is advanced and retracted relative to the crankshaft 16 by using the lathe cross-slide.

Next, the second actuator (not shown) rotates the burnishing tool 20 into engagement with the thrust faces 32. The rotation can be accomplished by using a hydraulic actuator, or as contemplated by the present invention, a torque wrench 72 attached to hexagonal appendage 71, as seen in FIG. 2. If one of the rollers 50 on the burnishing tool 20 should contact one thrust face 32 before the other when the burnishing tool 20 is rotated, the burnishing tool 20 floats laterally L and the crankshaft remains laterally fixed, unlike the prior art. As the burnishing tool 20 floats laterally, the housing 60 glides via the elongated guide rail members 74, 76 while the biasing members 60 expand or contract to accommodate this lateral movement L. The burnishing tool 20 ceases to move laterally once both rollers 50 are in contact with their respective thrust face 32. In this manner, force is applied from each burnishing roller 50 to each thrust face 32 evenly and distortion of the thrust faces 32 is prevented.

The invention has been described in an illustrative manner, and it is to be understood that the terminology, which has been used, is intended to be in the nature of word of description rather than limitation.

Obviously, many modifications and variations of the present invention are possible in the light of the above teachings. It is, therefore, to be understood that within the scope of the appended claims the invention may be practiced otherwise than specifically described.

What is claimed is:

1. A burnishing apparatus for simultaneously burnishing opposing and laterally spaced surfaces of a work piece when the work piece is rotatably driven about a horizontal axis of rotation comprising, a fixed platform, a burnisher housing having an elongated tool support shaft operatively mounted thereto for turning movement about a vertical axis, a slide unit operatively disposed between said fixed platform and said housing to allow said housing to be laterally adjusted relative to said platform in a path generally parallel the axis of rotation of said crankshaft, said support shaft having a burnishing tool affixed proximate to the lower end thereof which is adapted to be moved into the space between said laterally spaced surfaces of said work piece, said tool having a pair of opposing burnishing members for operative contact with the opposing laterally spaced surfaces of the work piece for burnishing the surfaces when said work piece is rotatably driven about said axis of rotation, and opposing biasing construction operatively disposed between said fixed platform and said housing to move said housing to a predetermined position relative to said fixed platform so that said support shaft and the tool can be positioned between said surfaces and so that said tool can be subsequently turned to turn at least one of said burnishing members into physical contact with at least one of said surfaces to effect a resultant movement of said burnisher housing relative to said fixed platform and thereby position said support shaft and the burnishing tool supported thereby in a centered position between said laterally spaced surfaces so that said burnishing members can physically contact and simultaneously burnish both of said spaced surfaces when said work piece is rotationally driven about the horizontal axis of rotation.

2. The burnishing apparatus of claim 1 in combination with a lathe having a pair of work piece holders for holding said work piece in a horizontally fixed position and for rotating said work piece about said horizontal axis of rotation, said lathe having a stationary tool post for supporting said fixed platform of said burnishing apparatus at a predetermined position adjacent to and offset from said work piece.

3. The burnishing apparatus of claim 1 in combination with a machine having a pair of work piece holders for holding said work piece in a horizontal position therebetween and for rotating said work piece about said horizontal axis of rotation, said machine having a stationary support for supporting said fixed platform of said burnishing apparatus at a predetermined position adjacent to and offset from said work piece and wherein said slide unit comprises a carrier and an associated slide rail slidably mounting said carrier therein for movement along said path generally parallel to said axis of rotation.

4. The burnishing apparatus of claim 1 wherein said centering biasing construction comprises opposing spring units operatively disposed between said fixed platform and said housing for centering said housing relative to said platform.

5. The burnishing apparatus of claim 4 wherein each of said opposing spring units comprise a spring housing fixed relative to said platform, a spring operatively mounted in said spring housing, and a plunger biased by said spring into contact with said housing to yieldably hold said housing in a predetermined position with respect to said platform.

6. The apparatus of claim 1 and further including a torque apply unit for said burnishing apparatus operable to exert torque loads on said shaft thereof until a predetermined burnishing load is applied to the opposing surfaces of the work piece by the operatively engagement of the opposing burnishing members of said burnishing tool with said opposing surfaces.

7. A method of burnishing opposing and laterally spaced first and second surfaces of an elongated work piece having an axis of rotation comprising the steps of:

a. loading the work piece into a work piece holder so that it extends in a predetermined direction and so that it can be rotatably driven about said axis of rotation, b. mounting a burnishing apparatus on a movable carrier at a work station offset from said work piece c. biasing said movable carrier and said burnishing apparatus with opposing biasing springs relative to a fixed support therefor in a first path generally parallel to said work piece and to said axis of rotation to a first station, d. moving a burnishing tool carried by the burnishing apparatus from the first station in a second path generally perpendicular to said first path into a position between said first and second surfaces of the work piece e. turning said burnishing tool in a first rotary direction about an axis generally perpendicular to said axis of rotation of said work piece until a first burnishing member carried by said tool physically contacts and grounds on a first face of said work piece, f. with the first burnishing member grounded on said first face, continuing the turning of said tool in said first rotary direction to effect the lateral shifting of said carrier against the opposing force of the biasing spring until a second burnishing member carried said tool physically contacts the second face of said work piece, and subsequently driving said work piece about its axis of rotation so that said burnishing members simultaneously burnish both of said laterally spaced first and second surfaces.

8. The method of claim 7 wherein said work piece is maintained in a laterally fixed position when loaded into said work piece holder.

9. The method of claim 7 and further including the step of turning said burnishing tool in the first rotary direction is by use of a torque apply tool until a predetermined load is applied to said first and second surfaces by said burnishing members.

10. The method of claim 7 and further including the step of disengaging said burnishing members of said burnishing tool from said surfaces so that said biasing members urge carrier and said burnishing apparatus back to the first station after said surfaces have been burnished.

11. A burnishing apparatus for simultaneously burnishing opposing and laterally spaced thrust faces of a crankshaft for an engine block when the crankshaft is rotatably driven about its axis of rotation comprising a fixed and stationary platform, a burnisher housing adapted to be adjustably supported at an operating station adjacent to and offset from said crankshaft and having an elongated tool support shaft operatively mounted thereto for limited turning movement about an axis generally perpendicular said axis of rotation of said crankshaft, a slide unit operatively disposed between said fixed platform and said housing to allow said housing to be laterally moved relative to said platform in a path parallel to the axis of rotation of said crankshaft, said support shaft having a burnishing tool affixed to the lower end thereof adapted to be moved into the space between said laterally spaced thrust faces of said crankshaft, said tool having a pair of opposing burnishing rollers for operative contact with the opposing laterally spaced thrust faces of the crankshaft and for burnishing the thrust faces of said crankshaft when said crankshaft is rotatably driven about said axis of rotation, and opposing spring members operatively mounted between said fixed platform and said housing to move said burnisher housing to a predetermined position so that said burnishing tool can be positioned between the thrust faces and then turned into a position in which at least one of said rollers makes initial physical contact with one of said thrust faces to resultantly move the burnisher housing relative to said fixed platform and thereby position said support shaft and the burnishing tool supported thereby in a centered position between said thrust faces and subsequently so that both of said burnishing rollers physically contact and simultaneously burnish both of said thrust faces when said crankshaft is rotatably driven about its axis of rotation.

* * * * *